US008955674B2

(12) United States Patent
Spivey, Sr. et al.

(10) Patent No.: US 8,955,674 B2
(45) Date of Patent: Feb. 17, 2015

(54) PACKAGE FOR CONTAINERS

(75) Inventors: Raymond R. Spivey, Sr., Mableton, GA (US); Jean-Manuel Gomes, Marietta, GA (US); Colin P. Ford, Woodstock, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 127 days.

(21) Appl. No.: 13/564,970

(22) Filed: Aug. 2, 2012

(65) Prior Publication Data

US 2013/0032496 A1 Feb. 7, 2013

Related U.S. Application Data

(60) Provisional application No. 61/574,654, filed on Aug. 5, 2011.

(51) Int. Cl.
*B65D 75/00* (2006.01)
*B65D 71/46* (2006.01)

(52) U.S. Cl.
CPC ..... *B65D 71/46* (2013.01)
USPC ..... 206/148; 206/427

(58) Field of Classification Search
CPC ..... B65D 71/46; B65D 71/40; B65D 71/42; B65D 71/00; B65D 85/20; B56D 75/00
USPC ..... 206/427, 139, 140, 145, 147–161, 434
See application file for complete search history.

(56) References Cited

U.S. PATENT DOCUMENTS

| | | | |
|---|---|---|---|
| 1,527,399 | A | 2/1925 | Davidson |
| 1,925,102 | A | 9/1933 | Levkoff |
| 2,005,924 | A | 6/1935 | Wilson |
| 2,067,749 | A | 1/1937 | Zimmerman et al. |

(Continued)

FOREIGN PATENT DOCUMENTS

| | | | |
|---|---|---|---|
| CA | 873185 | A1 | 6/1971 |
| DE | 202 13 450 | U1 | 11/2002 |

(Continued)

OTHER PUBLICATIONS

International Search Report and Written Opinion for PCT application No. PCT/US2011/063029 mailed Jul. 30, 2012.

(Continued)

*Primary Examiner* — Andrew Perreault
(74) *Attorney, Agent, or Firm* — Womble Carlyle Sandridge & Rice, LLP

(57) ABSTRACT

A package comprising a carrier holding at least one container. The carrier can comprise a bottom panel, first and second inner side panels foldably connected to the bottom panel, first and second outer side panels foldably connected to the respective first and second inner side panels, and first and second top panels foldably connected to the respective first and second outer side panels. At least one container-receiving feature can comprise a first retaining feature extending in at least the first inner side panel and an opposing second retaining feature extending in at least the second inner side panel. A top portion of the at least one container can be at least partially retained by the first and second retaining features. The bottom panel can be at least partially disposed between the top portion of the at least one container and at least one of the first and second top panels.

33 Claims, 6 Drawing Sheets

(56) References Cited

U.S. PATENT DOCUMENTS 2,115,673 A 4/1938 Stompe
2,289,859 A 7/1942 Arthur
2,299,027 A 10/1942 Novak
2,331,038 A 10/1943 Meller
2,522,950 A 9/1950 Keith
2,669,351 A 2/1954 Carson et al.
2,754,047 A 7/1956 Schmidt et al.
2,798,603 A 7/1957 Grinspoon
2,950,041 A 8/1960 Stone
3,005,654 A 10/1961 Stone et al.
3,075,799 A 1/1963 Weiss
3,078,032 A 2/1963 Robinson et al.
3,128,010 A 4/1964 Forrer
3,133,634 A 5/1964 Bozdar
3,137,109 A 6/1964 Rapata
3,156,358 A 11/1964 Randrup
3,175,682 A 3/1965 Forrer
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,363,928 A 1/1968 Haufe et al.
3,414,313 A 12/1968 Schwarz
3,503,498 A 3/1970 Lawrence
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,627,121 A 12/1971 Deasy
3,653,503 A 4/1972 Arneson
3,701,416 A 10/1972 Lawrence
3,722,945 A 3/1973 Wood
3,752,305 A 8/1973 Heyne
3,897,873 A 8/1975 Graser
3,942,631 A 3/1976 Sutherland et al.
4,029,204 A 6/1977 Manizza
4,155,449 A 5/1979 Bryne
4,192,540 A 3/1980 Oliff
4,214,660 A 7/1980 Hunt, Jr.
4,216,861 A 8/1980 Oliff
4,222,485 A 9/1980 Focke
4,256,226 A 3/1981 Stone
4,272,010 A * 6/1981 Capo ..... 229/125.27
4,304,329 A 12/1981 Graser
4,305,500 A 12/1981 Jaeschke
4,318,474 A 3/1982 Hasegawa
4,326,628 A 4/1982 Wood
4,336,898 A 6/1982 Joyce
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,879 A 4/1983 Killy
4,382,505 A 5/1983 Sutherland et al.
4,396,143 A 8/1983 Killy
4,398,636 A 8/1983 Baxter
4,417,655 A 11/1983 Forbes, Jr.
4,417,661 A 11/1983 Roccaforte
4,566,591 A 1/1986 Turtschan et al.
4,577,762 A 3/1986 Kuchenbecker
4,605,128 A 8/1986 Rieke
4,658,984 A 4/1987 Brunner
4,703,847 A 11/1987 Oliff
4,784,266 A 11/1988 Chaussadas
4,807,751 A 2/1989 Klygis et al.
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,103,971 A 4/1992 Schuster
5,137,211 A 8/1992 Summer et al.
5,139,147 A 8/1992 Sutherland
5,163,548 A 11/1992 Domansky
5,188,225 A 2/1993 Jorba
5,201,412 A 4/1993 Schuster et al.
5,219,229 A 6/1993 Sengewald
5,234,103 A 8/1993 Schuster
5,246,113 A 9/1993 Schuster
5,249,681 A 10/1993 Miller
5,267,644 A 12/1993 Tsao
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A 12/1995 Weber
5,482,185 A 1/1996 McNaughton
5,484,059 A 1/1996 Sutherland
5,503,267 A 4/1996 Sutherland
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,620,094 A 4/1997 Naumann
5,622,309 A 4/1997 Matsuda et al.
5,664,683 A 9/1997 Brody
5,667,070 A 9/1997 Miret
5,687,838 A 11/1997 Bakx
5,690,213 A 11/1997 Matsumura
5,690,230 A 11/1997 Griffith
5,706,936 A 1/1998 Bernstein
5,711,419 A 1/1998 Beales et al.
5,746,310 A 5/1998 Slomski
5,791,463 A 8/1998 Negelen
5,794,778 A 8/1998 Harris
5,816,391 A 10/1998 Harris
5,820,185 A 10/1998 Gomes
5,826,783 A 10/1998 Stout
5,875,961 A 3/1999 Stone et al.
5,881,884 A 3/1999 Podosek
5,921,392 A 7/1999 Davis
5,921,398 A 7/1999 Carroll
5,924,559 A 7/1999 Carrel et al.
5,927,498 A 7/1999 Saam
5,960,945 A 10/1999 Sutherland
6,039,181 A 3/2000 Whiteside
6,050,402 A 4/2000 Walter
6,059,099 A 5/2000 Galbierz
6,176,419 B1 1/2001 Holley, Jr.
6,223,892 B1 5/2001 Bakx
6,241,083 B1 6/2001 Harrelson
6,283,293 B1 9/2001 Lingamfelter
6,315,111 B1 11/2001 Sutherland
6,394,272 B1 5/2002 Domansky
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,488,322 B2 12/2002 Bakx
6,550,615 B2 4/2003 Lingamfelter

(56) References Cited

U.S. PATENT DOCUMENTS

| | | | |
|---|---|---|---|
| 6,557,699 | B1 | 5/2003 | Focke et al. |
| 6,578,736 | B2 | 6/2003 | Spivey |
| 6,604,677 | B1 | 8/2003 | Sutherland et al. |
| 6,669,083 | B2 | 12/2003 | Bates |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,866,186 | B2 | 3/2005 | Fogle et al. |
| 6,866,188 | B2 | 3/2005 | Harrelson |
| 6,896,130 | B2 | 5/2005 | Theelen |
| 6,902,104 | B2 | 6/2005 | Holley, Jr. et al. |
| 6,918,487 | B2 | 7/2005 | Harrelson |
| 6,929,172 | B2 | 8/2005 | Bates et al. |
| 6,945,450 | B2 | 9/2005 | Rusnock |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,011,209 | B2 | 3/2006 | Sutherland et al. |
| 7,083,046 | B2 | 8/2006 | Bakx |
| 7,104,435 | B2 | 9/2006 | Holley, Jr. |
| 7,134,593 | B2 | 11/2006 | Harrelson |
| 7,163,103 | B2 | 1/2007 | Bakx et al. |
| 7,168,558 | B2 | 1/2007 | Harrelson |
| 7,225,930 | B2 | 6/2007 | Ford et al. |
| 7,240,789 | B2 | 7/2007 | Sutherland |
| 7,264,114 | B2 | 9/2007 | Daniel |
| 7,374,038 | B2 | 5/2008 | Smalley |
| 7,690,507 | B2 | 4/2010 | Sutherland |
| 7,721,878 | B2 | 5/2010 | Requena |
| 7,766,181 | B2 | 8/2010 | Fogle et al. |
| 7,789,231 | B2 | 9/2010 | Requena |
| 7,823,721 | B2 | 11/2010 | Sutherland |
| 8,056,709 | B2 | 11/2011 | Sutherland |
| 8,061,519 | B2 | 11/2011 | Taglione |
| 8,096,413 | B2 | 1/2012 | De Paula |
| 8,162,135 | B2 | 4/2012 | Oliveira |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2002/0195371 | A1 | 12/2002 | Brown |
| 2003/0080004 | A1 | 5/2003 | Olsen et al. |
| 2003/0141313 | A1 | 7/2003 | Bates |
| 2003/0150759 | A1 | 8/2003 | White, Jr. |
| 2003/0192907 | A1 | 10/2003 | Bates |
| 2003/0213705 | A1 | 11/2003 | Woog |
| 2004/0011674 | A1 | 1/2004 | Theelen |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0226833 | A1 | 11/2004 | Daniel |
| 2005/0023170 | A1 | 2/2005 | Lingamfelter |
| 2005/0092820 | A1 | 5/2005 | Chekroune |
| 2005/0103650 | A1 | 5/2005 | Auclair et al. |
| 2005/0126947 | A1 | 6/2005 | Holley, Jr. |
| 2005/0127151 | A1 | 6/2005 | Johnson |
| 2005/0178791 | A1 | 8/2005 | Miller |
| 2005/0189405 | A1 | 9/2005 | Gomes et al. |
| 2005/0224565 | A1 | 10/2005 | Holley |
| 2006/0054522 | A1 | 3/2006 | Kline et al. |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2008/0121536 | A1 | 5/2008 | Miret |
| 2008/0135423 | A1 | 6/2008 | Oliveira |
| 2009/0101526 | A1 | 4/2009 | Sutherland et al. |
| 2009/0127147 | A1 | 5/2009 | Sutherland |
| 2010/0264043 | A1 | 10/2010 | De Paula |
| 2011/0000799 | A1 | 1/2011 | Gonzalez |
| 2011/0284623 | A1 | 11/2011 | Jones et al. |
| 2012/0080328 | A1 | 4/2012 | De Paula |
| 2012/0138489 | A1* | 6/2012 | Holley, Jr. ..... 206/153 |
| 2012/0285854 | A1* | 11/2012 | Spivey, Sr. ..... 206/427 |

FOREIGN PATENT DOCUMENTS

| | | | |
|---|---|---|---|
| EP | 0 066 029 | A1 | 12/1992 |
| EP | 0 636 554 | A2 | 2/1995 |
| EP | 0 806 372 | | 6/1997 |
| EP | 1 384 679 | A1 | 1/2004 |
| FR | 2 549 010 | | 1/1985 |
| GB | 2 264 101 | A | 8/1993 |
| JP | 2003-146359 | | 5/2003 |
| WO | WO 93/25439 | A1 | 12/1993 |
| WO | WO 96/29260 | | 9/1996 |
| WO | WO 98/49071 | A1 | 11/1998 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | A1 | 6/2005 |
| WO | WO 2006/050210 | A2 | 5/2006 |
| WO | WO 2006/050316 | A1 | 5/2006 |
| WO | WO 2007/089844 | A1 | 8/2007 |

OTHER PUBLICATIONS

International Search Report and Written Opinion for related PCT application No. PCT/US2012/037461 mailed Nov. 14, 2012.
International Search Report and Written Opinion for PCT/US2012/049272 mailed Dec. 14, 2012.

* cited by examiner

PACKAGE FOR CONTAINERS

CROSS-REFERENCE TO RELATED APPLICATIONS

This application claims the benefit of U.S. Provisional Patent Application No. 61/574,654, filed Aug. 5, 2011.

INCORPORATION BY REFERENCE

The disclosure of U.S. Provisional Patent Application No. 61/574,654, which was filed on Aug. 5, 2011, is hereby incorporated by reference for all purposes as if presented herein in its entirety.

BACKGROUND OF THE DISCLOSURE

The present disclosure generally relates to cartons for holding and dispensing beverage containers, cans, or other types of articles. More specifically, the present disclosure relates to cartons that clip onto at least a portion of one or more containers.

SUMMARY OF THE DISCLOSURE

In general, one aspect of the disclosure is generally directed to a package comprising a carrier holding at least one container. The carrier can comprise a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, and a second top panel foldably connected to the second outer side panel. At least one container-receiving feature can comprise a first retaining feature extending in at least the first inner side panel and an opposing second retaining feature extending in at least the second inner side panel. A top portion of the at least one container can be at least partially retained by each of the first retaining feature and the second retaining feature. The bottom panel can be at least partially disposed between the top portion of the at least one container and at least one of the first top panel and the second top panel.

In another aspect, the disclosure is generally directed to a blank for forming a carrier for at least partially holding at least one container. The blank comprises a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, and a second top panel foldably connected to the second outer side panel. At least one container-receiving feature can comprise a first retaining feature extending in at least the first inner side panel and an opposing second retaining feature extending in at least the second inner side panel. The first retaining feature and the second retaining feature can be for at least partially retaining a top portion of the at least one container in the carrier formed from the blank. The bottom panel is for being at least partially disposed between the top portion of the at least one container and at least one of the first top panel and the second top panel when the carrier is formed from the blank.

In another aspect, the disclosure is generally directed to a method of forming a package. The method comprises obtaining a blank comprising a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, a second top panel foldably connected to the second outer side panel, and at least one container-receiving feature comprising a first retaining feature extending in at least the first inner side panel and an opposing second retaining feature extending in at least the second inner side panel. The method further can comprise engaging at least one container with the at least one container-receiving feature by folding the first inner side panel and the second inner side panel generally downwardly so that a top portion of the at least one container is at least partially retained in each of the first retaining feature and the second retaining feature. The method further can comprise forming a carrier having an interior by positioning the first top panel and the second top panel to overlap the bottom panel so that the bottom panel is at least partially disposed between the top portion of the at least one container and at least one of the first top panel and the second top panel.

Other aspects, features, and details of the present disclosure can be more completely understood by reference to the following detailed description, taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded ore reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to carriers, constructs, sleeves, cartons, or the like, and packages for holding and displaying containers such as cups, jars, bottles, cans, etc. The containers can be used for packaging food and beverage products, for example. The containers can be made from materials suitable in composition for packaging the particular food or beverage item, and the materials include, but are not limited to, glass and the like; plastics such as PET, LDPE, LLDPE, HDPE, PP, PS, PVC, EVOH, and Nylon; aluminum and/or other metals; or any combination thereof.

Carriers according to the present disclosure can accommodate containers of numerous different shapes. For the purpose of illustration and not for the purpose of limiting the scope of the disclosure, the following detailed description describes food product containers (e.g., glass jars, plastic containers, or aluminum cans) at least partially disposed within the carrier embodiments. In this specification, the terms "lower," "bottom," "upper," "top," "inner," and "outer" indicate orientations determined in relation to fully erected carriers or packages.

Figure 1:
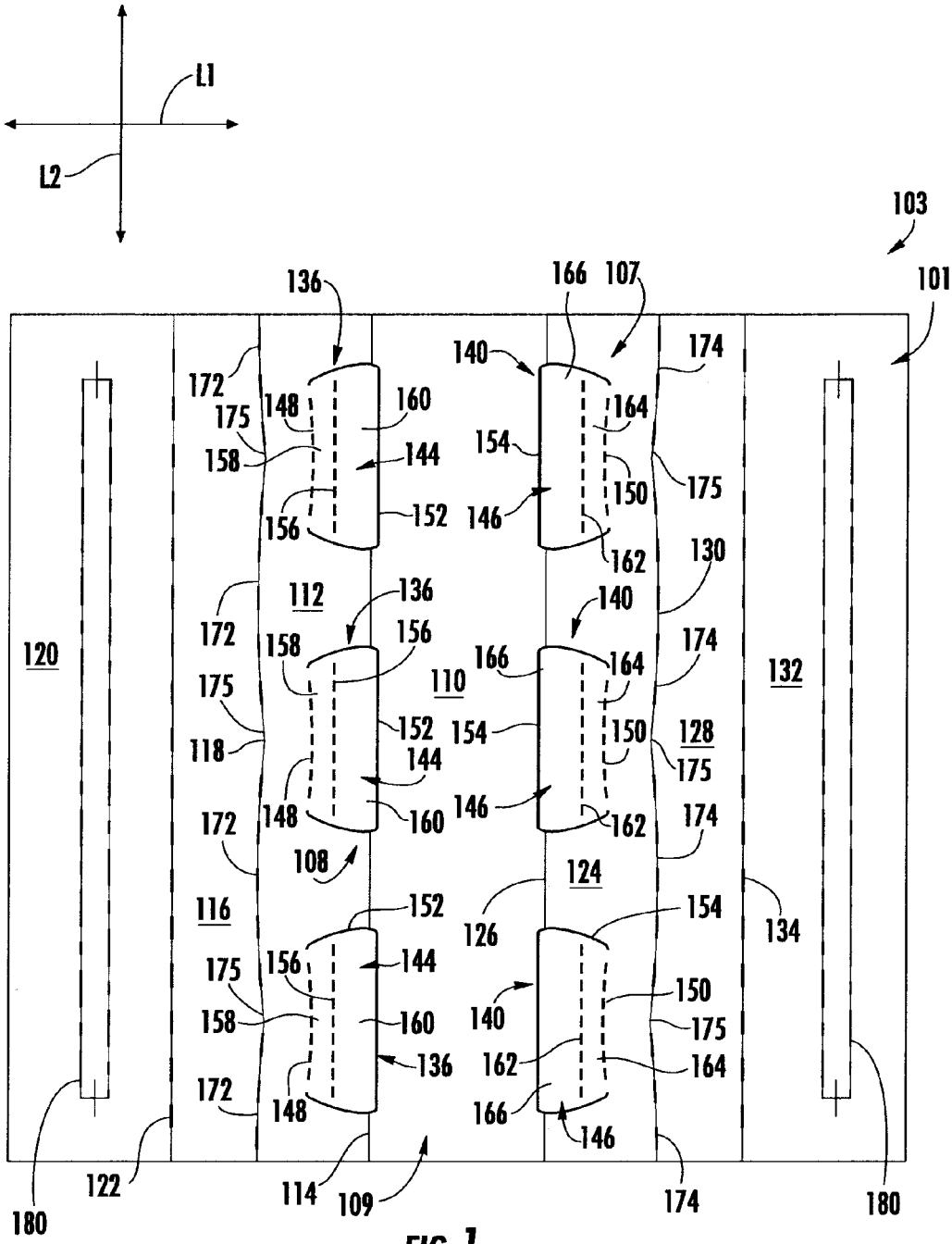
FIG. 1 is an interior plan view of a blank for forming a carrier according to an exemplary embodiment of the disclosure.

FIG. 1 is a plan view of an interior side 101 of a blank 103 used to form a carton or carrier 105 according to a first embodiment of the disclosure. The blank 103 has a longitudinal axis L1 and a lateral axis L2. The carrier 105 is illustrated in its erected state in FIGS. 4-6, in which it is attached to upper portions of containers C, forming a package 106. Each of the containers C can be at least partially retained in a respective container-receiving feature 107, 108, 109. In the illustrated embodiments the containers C are illustrated as glass jars having a top portion or lid L generally comprising a rim R; however, other containers may be held in the package 106 without departing from the disclosure. As shown in FIG. 1, the blank 103 may be wholly or partially symmetric about a longitudinal axis L1. Therefore, certain elements in the drawing figures share common or similar reference numerals in order to reflect the whole and/or partial symmetries.

Referring to FIG. 1, the blank 103 comprises a bottom panel 110 foldably connected to a first inner side panel 112 at a first transverse fold line 114, a first outer side panel 116 foldably connected to the first inner side panel 112 at a second transverse fold line 118, a first top panel 120 foldably connected to the first outer side panel 116 at a third transverse fold line 122, a second inner side panel 124 foldably connected to the bottom panel 110 at a fourth transverse fold line 126, a second outer side panel 128 foldably connected to the second inner side panel 124 at a fifth transverse fold line 130, and a second top panel 132 foldably connected to the second outer side panel 128 at a sixth transverse fold line 134.

In the illustrated embodiment, the container-receiving portions 107, 108, 109 are arranged in a single row. Each container-receiving portion 107, 108, 109 is shaped and sized to receive at least the lid L of one of the containers C that is to be held within the erected carrier 105. In the exemplary embodiment, three containers C are accommodated in the erected carrier 105, forming the 1×3 package 106. Other package configurations holding more or less than three containers, such as 1×2, 1×4, or 2×2, etc. are also within the scope of the present disclosure.

As shown in FIG. 1, each container-receiving portion 107, 108, 109 includes a first retaining feature 136 extending in the first inner side panel 112, and a second retaining feature 140 extending in the second inner side panel 124. The first and second retaining features 136, 140 each includes a respective retention flap 144, 146 foldably connected to the respective inner side panel 112, 124 along a respective retention fold line 148, 150. The retention fold lines 148, 150 can be curved to form respective curved retention edges that project into the openings formed by the retention flaps 144, 146 in the erected carrier. The retention flaps 144, 146 can be further defined by respective generally U-shaped tear lines or cut lines 152, 154. In one embodiment, the generally U-shaped cut lines 152, 154 can extend into the bottom panel 110, interrupting the respective transverse fold lines 114, 126 so that the respective retention flaps 144, 146 extend into the bottom panel 110. An intermediate transverse fold line 156 extends in each of the retention flaps 144 to form a respective inner portion 158 and outer portion 160 of each retention flap 144. Similarly, an intermediate transverse fold line 162 extends in each of the retention flaps 146 to form a respective inner portion 164 and outer portion 166 of each retention flap 146. Alternatively, the container-receiving portions 107, 108, 109 can be omitted or otherwise shaped, arranged, positioned, and/or configured without departing from the disclosure.

As shown in FIG. 1, each of the second and fifth transverse fold lines 118, 130 can include one or more respective arcuate segments 172, 174 curving into the respective first and second outer side panels 116, 128. The transverse fold lines 118, 130 further include pinching portions 175 that curve inwardly toward the bottom panel 110 and are aligned with the respective retaining features 136, 140. The pinching portions 175 in the transverse fold line 118 are formed where the ends of adjacent arcuate segments 172 meet, and the pinching portions 175 in the transverse fold line 130 are formed where the ends of adjacent arcuate segments 174 meet. In the carrier 105, the arcuate segments 172, 174 and the pinching portions 175 form a respective curved edge 176, 178 (FIG. 6) at the respective fold lines 118, 130. The first and second inner side panels 112, 124 and the first and second outer side panels 116, 128 curve inwardly in the carrier 105 at the pinching portions 175 to help reinforce the respective retaining features 136, 140 and retain the containers C in the container-receiving portions 107, 108, 109.

Figure 3:
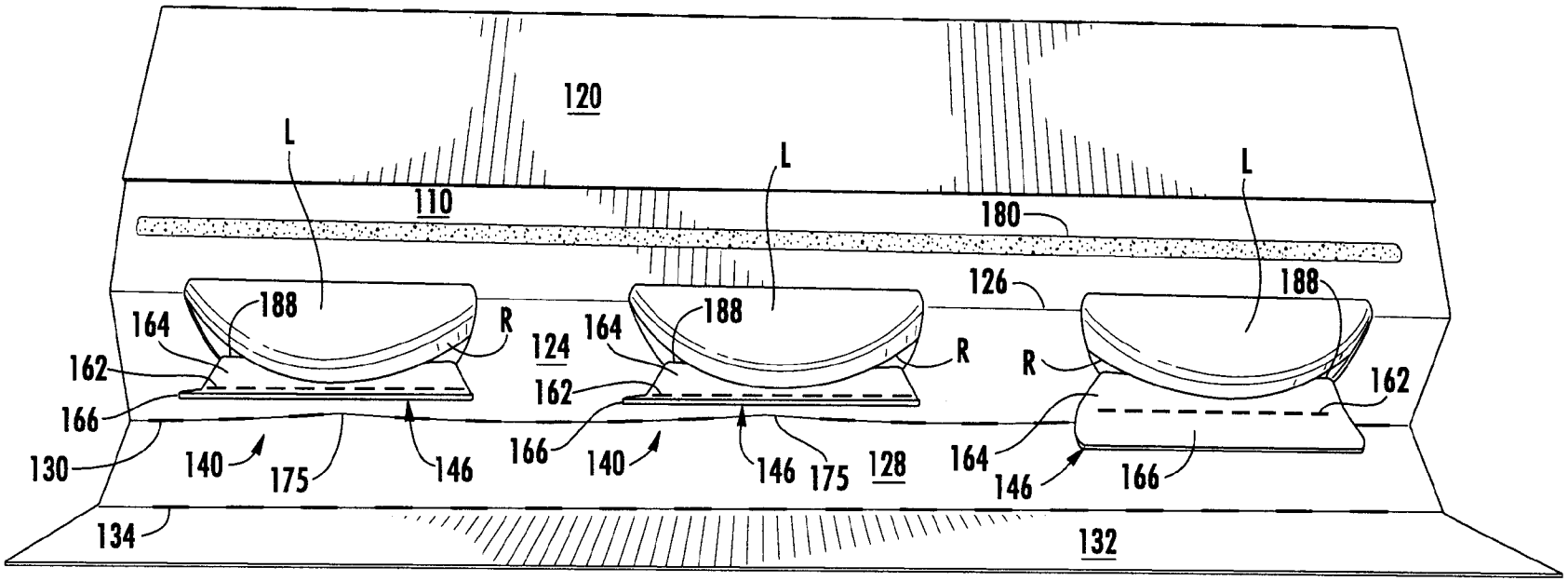
FIG. 3 is a perspective view of the partially formed carrier that is further assembled according to the exemplary embodiment of the disclosure.

In the illustrated embodiment, the first and second top panels 120, 132 can include glue areas 180 on the interior surface 101. Alternatively, or in addition, the bottom panel 110 can include one or more glue areas (FIG. 3). The glue areas 180 can be omitted or otherwise shaped, arranged, positioned, and/or configured without departing from the disclosure. In an alternative embodiment, the top panels 120, 132 can include locking features for interlocking the top panels. For example, the first top panel 120 can include primary and secondary locking tabs that engage respective primary and secondary locking openings in the second top panel 132. The locking features can be otherwise configured without departing from the disclosure. In a further alternative embodiment, the bottom panel 110 can include locking features (e.g., locking tabs or openings) for interlocking with locking features (e.g., locking openings or tabs) in the first top panel 120 and/or the second top panel 132.

Figure 2:
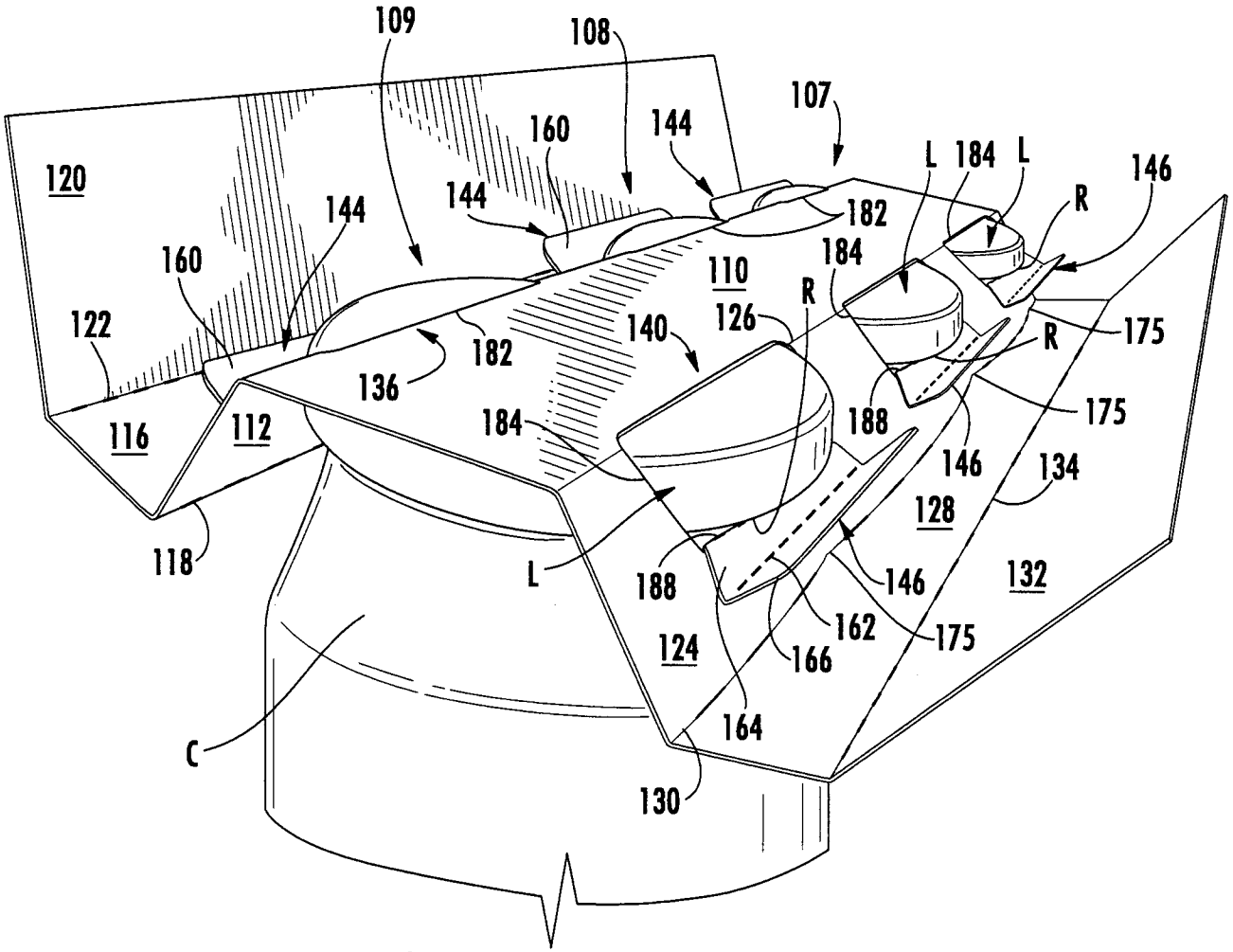
FIG. 2 is a perspective view of a partially formed carrier engaging a plurality of containers according to the exemplary embodiment of the disclosure.
Figure 6:
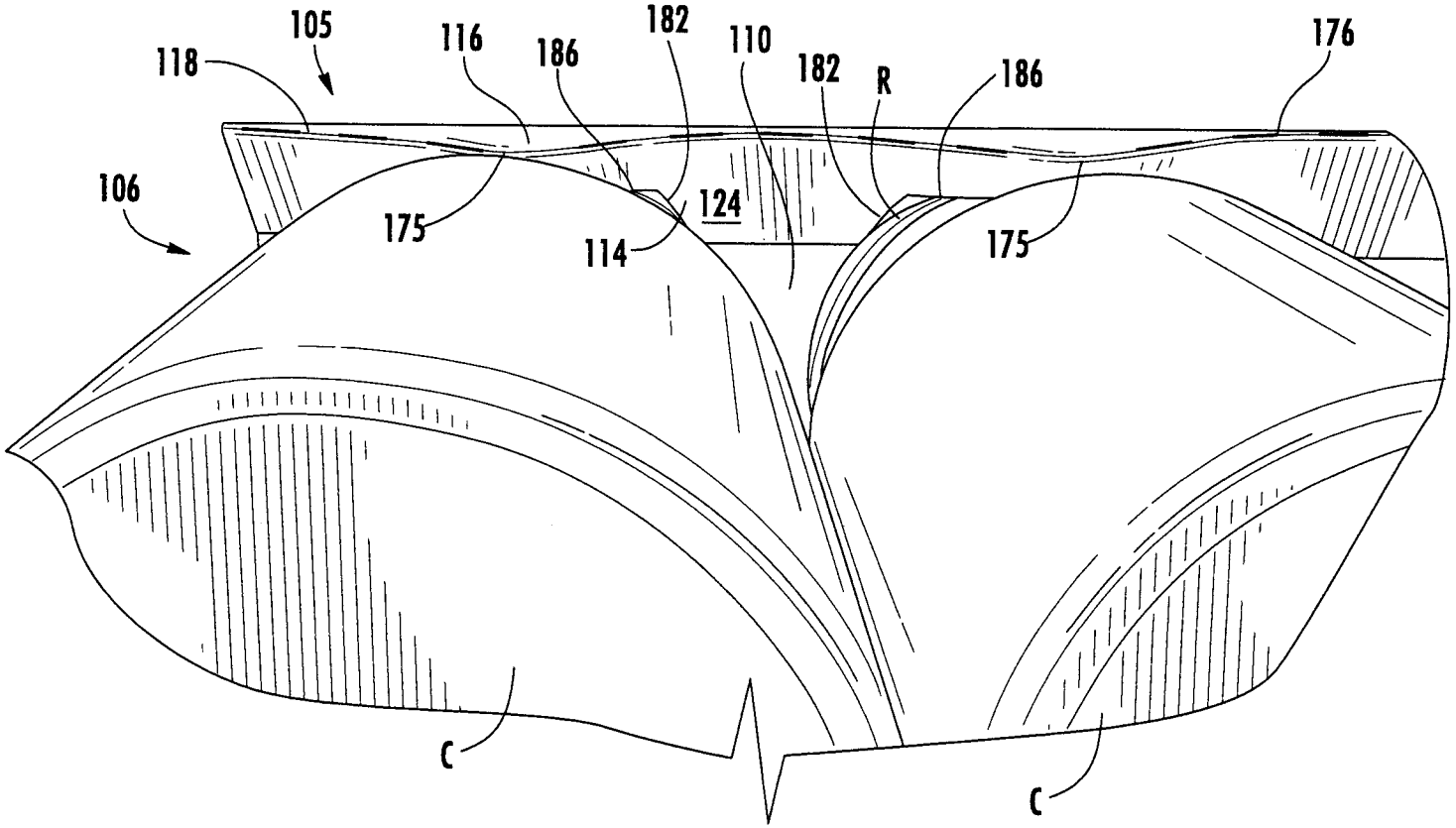
FIG. 6 is a perspective view of the underside of the erected package of FIG. 4.

An exemplary method of erection of the carrier 105 to form the package 106 is discussed below with reference to FIGS. 2 and 3. As shown in FIG. 2, the retention flaps 144, 146 are folded inwardly along the respective curved retention fold lines 148, 150 to form openings 182, 184 in the respective inner side panels 112, 124. In one embodiment, an edge of the bottom panel extends adjacent to each of the openings 182, 184, which interrupt the respective transverse fold lines 114, 126. When the retention flaps 144, 146 are folded, the curved retention fold lines 148, 150 form respective curved retention edges 186, 188 (FIGS. 2, 3, and 6). In the illustrated embodiment, the curved retention edges 186, 188 form convex curves that project into the respective openings 182, 184. As shown in FIG. 2, with the interior surface 101 facing upwardly, the blank 3 is placed over the containers C so that each of the lids L is aligned with a respective container-receiving portion 107, 108, 109, and the inner side panels 112, 124 are folded generally downwardly along respective transverse fold lines 114, 126. Accordingly, each of two opposed, radially outer portions of each of the lids L extends through or is received in a respective one of the openings 182, 184. The bottom panel 110 extends across and is in contact with the top surface of the lids L. The curved retention edges 186, 188 are inserted under the rims R at the bottoms of the lids L on either side of each container C so that the retention edges 186, 188 project into the interiors of the lids L. Accordingly, the curved retention edges 186, 188 can engage an interior of the respective rims R. In the illustrated embodiment, the curved retention edges 186, 188 are spaced apart from the top panel a distance that provides a tight fit of the rim R in the respective openings 182, 184. Accordingly the lids L at the top portions of the containers C are retained by the respective container-receiving portions 107, 108, 109.

Figure 5:
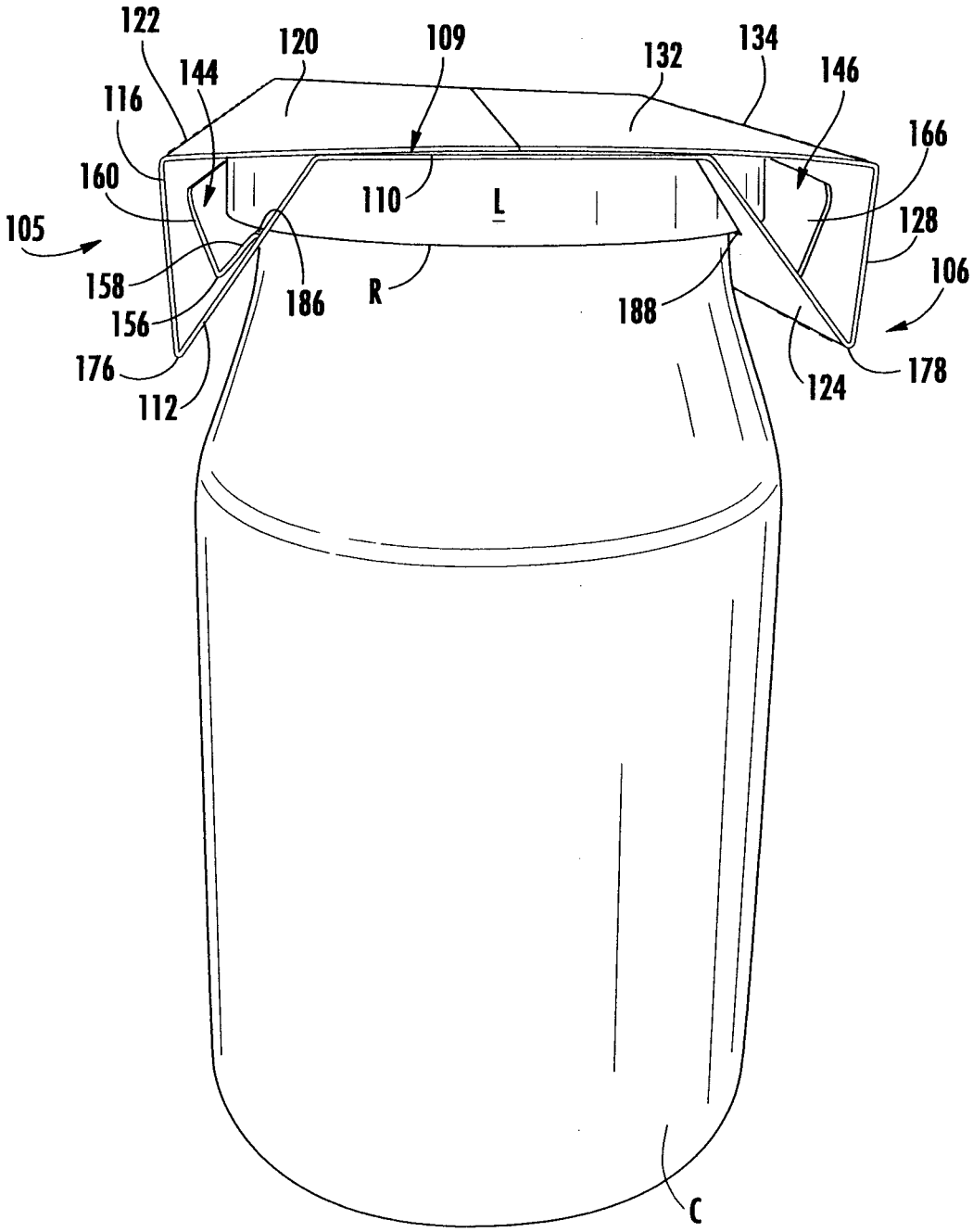
FIG. 5 is a perspective end view of the erected package of FIG. 4.

As shown in FIGS. 2, 3, and 5, the retention flaps 144, 146 are folded along the respective transverse fold lines 156, 162, and glue can be applied to the interior side 101 of the bottom panel 110 and/or the first and second top panels 120, 132 (e.g., at glue areas 180). The first and second outer side panels 116, 128 can be folded generally upwardly along the respective transverse fold lines 118, 130 to form the curved edges 176, 178, and the first and second top panels 120, 132 can be folded along the respective transverse fold lines 122, 134 to overlap the bottom panel 110. Accordingly, the top panels 120, 132 are glued in face-to-face contact with the bottom panel 110 so that the bottom panel is disposed between the top surfaces of the lids L and the first and second top panels. The transversely-extending edges of the top panels 120, 132 can be disposed adjacent or abutting one another. Alternatively, one of the top panels 120, 132 can at least partially overlap the other. In an alternative embodiment, the carrier 105 can be closed by any suitable closure features. For example, any of the top panels 120, 132 and the bottom panel 110 can include locking features. Accordingly, instead of or in addition to gluing the top panels 120, 132 to the bottom panel 110, the top panels 120, 132 can be interlocked with one another and/or with the bottom panel 110.

As the outer side panels 116, 128 are folded upwardly, the outer portions 160, 166 of the respective retention flaps 144, 146 can be folded upwardly (e.g., by contact with the interior surfaces of the outer side panels 116, 128) and extend generally upwardly from the respective fold lines 156, 162 to a respective free edge of the retention flaps 144, 146 (FIGS. 2 and 5). The inner portions 158, 164 of the respective retention flaps 144, 146 can extend generally downwardly from the respective curved retention edges 186, 188 to the respective intermediate transverse fold lines 156, 162 along the respective first and second inner side panels 112, 124. Alternatively, the retention flaps 144, 146 can be folded along the respective curved retention fold lines 148, 150 and/or the respective intermediate transverse fold lines 156, 162 before folding the blank 103 along any or all of the transverse fold lines 114, 118, 122, 126, 130, 134. As shown in FIGS. 2 and 5, the retention flaps 144 extend at least partially between the first inner side panel 112 and the first outer side panel 116, and the first inner portions 158 and the first outer portions 160 extend generally upwardly from the respective intermediate transverse fold lines 156. Similarly, the retention flaps 146 extend at least partially between the second inner side panel 124 and the second outer side panel 128, and the second inner portions 164 and the second outer portions 166 extend generally upwardly from the respective intermediate transverse fold lines 162. In one embodiment, the outer portions 160, 166 of the respective retention flaps 144, 146 can contact the interior surface of the respective outer side panels 116, 128 in the fully erected carrier 105.

Accordingly, in the illustrated embodiment, the containers C are supported or retained at the rims R by the retention features 136, 140. Any force tending to pull one or more of the containers C away from the carrier 105 is resisted by at least the curved retention edges 186, 188 engaging under the rims R. The inner side panels 112, 124 support the rims R at the respective curved retention edges 186, 188, and the retention flaps 144, 146 can reinforce the respective inner side panels 112, 124. In addition, as shown in FIG. 6, the pinching portions 175 of the curved edge 176 can cause the inner side panel 112 and the outer side panel 116 to curve inwardly at the retention features 136. The pinching portions 175 in the curved edges 178 are similarly configured. Accordingly, the pinching portions 175 of the curved edges 176, 178 help further retain the containers C in the container-receiving portions 107, 108, 109. For example, in one embodiment, the pinching portions 175 urge the inner side panels 112, 124 and the outer side panels 116, 128 inwardly at the retention features 136, 140 against the containers C, which can help urge the retention edges 186, 188 under the rims R of the containers.

In an alternative embodiment, the carrier 105 can be otherwise arranged or erected without departing from the present disclosure.

Figure 4:
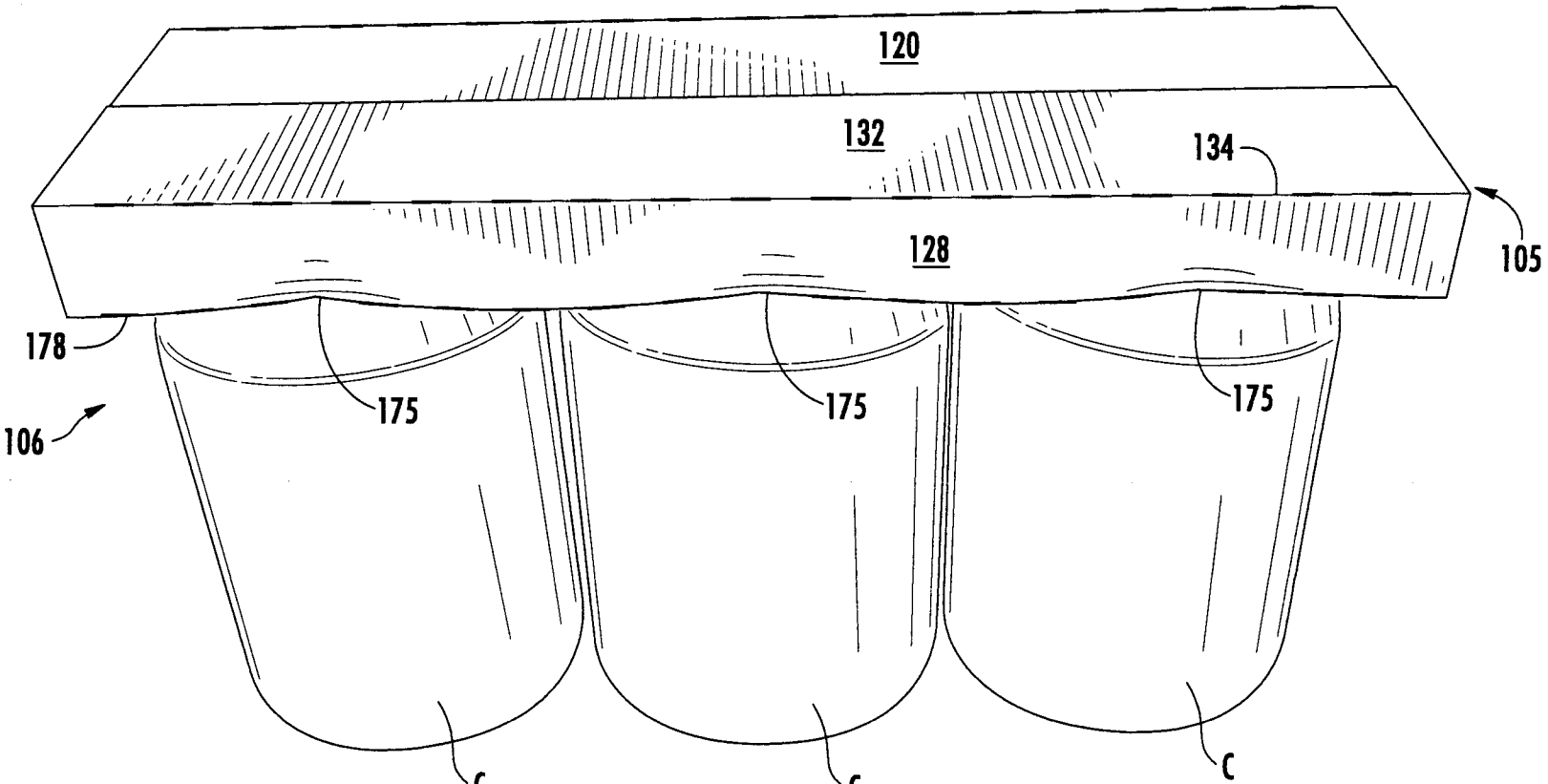
FIG. 4 is a perspective side view of the erected carrier and containers forming a package according to the exemplary embodiment of the disclosure.

The erected package 106, in which the carrier 105 retains the top portions of the containers C in respective container-receiving portions 107, 108, 109, is shown in FIGS. 4-6. In the illustrated embodiment, the carrier 105 is open-ended, and the inner side panels 112, 124 can extend in a generally oblique direction from the bottom panel 110. The outer side panels 116, 128 can extend generally vertically from the respective top panels 120, 132. In an alternative embodiment, one or more end panels can be foldably connected to one or more of the bottom panel 110, the side panels 112, 116, 124, 128, and the top panels 120, 132.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising a carrier and at least one container held in the carrier, the carrier comprising:

a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, and a second top panel foldably connected to the second outer side panel;

at least one container-receiving feature comprising a first retaining feature extending in at least the first inner side panel and an opposing second retaining feature extending in at least the second inner side panel, a top portion of the at least one container being at least partially retained by each of the first retaining feature and the second retaining feature, wherein at least one of the first retaining feature and the second retaining feature comprises at least one retention flap foldably connected to a respective one of the first inner side panel and the second inner side panel along at least one retention fold line, the at least one retention fold line engaging an underside of the top portion of the at least one container; and the bottom panel is at least partially disposed between the top portion of the at least one container and at least one of the first top panel and the second top panel.

2. The package of claim 1, wherein the first retaining feature comprises a first opening in at least the first inner side panel and the second retaining feature comprises a second opening in at least the second inner side panel, the top portion of the at least one container being at least partially received in the first opening and the second opening.

3. The package of claim 2, wherein the first retaining feature further comprises a first retention edge adjacent the first opening and the second retaining feature further comprises a second retention edge adjacent the second opening, the first retention edge and the second retention edge engaging the underside of the top portion of the at least one container.

4. The package of claim 3, wherein each of the first retention edge and the second retention edge comprises a convex curve.

5. The package of claim 2, wherein the at least one retention flap comprises a first retention flap and a second retention flap, and the at least one retention fold line comprises a first retention fold line and a second retention fold line, the first retention flap is foldably connected to the first inner side panel along the first retention fold line adjacent the first opening, and the second retention flap is foldably connected to the second inner side panel along the second retention fold line adjacent the second opening, the first retention fold line and the second retention fold line engaging the underside of the top portion of the at least one container.

6. The package of claim 5, wherein the first retention flap comprises a first inner portion foldably connected to a first outer portion along a first intermediate fold line, the second retention flap comprises a second inner portion foldably connected to a second outer portion along a second intermediate fold line.

7. The package of claim 6, wherein the first retention flap extends at least partially between the first inner side panel and the first outer side panel, and the second retention flap extends at least partially between the second inner side panel and the second outer side panel.

8. The package of claim 6, wherein the first inner portion is folded generally downwardly from the first retention fold line, and the second inner portion is folded generally downwardly from the second retention fold line.

9. The package of claim 8, wherein the first retention flap is folded along the first intermediate fold line so that the first inner portion and the first outer portion extend generally upwardly from the first intermediate fold line, and the second retention flap is folded along the second intermediate fold line so that the second inner portion and the second outer portion extend generally upwardly from the second intermediate fold line.

10. The package of claim 9, wherein at least a portion of the first outer portion engages an interior surface of the first outer side panel, and at least a portion of the second outer portion engages an interior surface of the second outer side panel.

11. The package of claim 5, wherein the first inner side panel is foldably connected to the bottom panel along a first fold line, the second inner side panel is foldably connected to the bottom panel along a second fold line, the first opening is at least partially defined by a first edge of the bottom panel and interrupts the first fold line, and the second opening is at least partially defined by a second edge of the bottom panel and interrupts the second fold line.

12. The package of claim 1, wherein the first inner side panel extends generally downwardly in a first oblique direction from the bottom panel to the first outer side panel, and the second inner side panel extends generally downwardly in a second oblique direction from the bottom panel to the second outer side panel.

13. The package of claim 1, wherein the first inner side panel is foldably connected to the first outer side panel along a first fold line, the second inner side panel is foldably connected to the second outer side panel along a second fold line, the first fold line comprises at least one first curved portion aligned with the first retaining feature, and the second fold line comprises at least one second curved portion aligned with the second retaining feature.

14. The package of claim 13, wherein the at least one first curved portion is curved inwardly so that the first inner side panel and the first outer side panel are partially curved inwardly toward the at least one container at the first fold line, and the at least one second curved portion is curved inwardly so that the second inner side panel and the second outer side panel are partially curved inwardly toward the at least one container at the second fold line.

15. The package of claim 1, wherein the at least one retention flap comprises an inner portion foldably connected to an outer portion along an intermediate fold line, and the inner portion is folded generally downwardly from the at least one retention fold line.

16. The package of claim 15, wherein the at least one retention flap is folded along the intermediate fold line so that the inner portion and the outer portion extend generally upwardly from the first intermediate fold line.

17. The package of claim 16, wherein at least a portion of the outer portion of the at least one retention flap engages an interior surface of one of the first outer side panel and the second outer side panel.

18. A blank for forming a carrier for at least partially holding at least one container, the blank comprising:

a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, and a second top panel foldably connected to the second outer side panel; and at least one container-receiving feature comprising a first retaining feature extending in at least the first inner side panel and an opposing second retaining feature extending in at least the second inner side panel, the first retaining feature and the second retaining feature being for at least partially retaining a top portion of the at least one container in the carrier formed from the blank, wherein at least one of the first retaining feature and the second retaining feature comprises at least one retention flap foldably connected to a respective one of the first inner side panel and the second inner side panel along at least one retention fold line, the at least one retention fold line being for engaging an underside of the top portion of the at least one container when the carrier is formed from the blank; and wherein the bottom panel is for being at least partially disposed between the top portion of the at least one container and at least one of the first top panel and the second top panel when the carrier is formed from the blank.

19. The blank of claim 18, wherein the at least one retention flap comprises a first retention flap for forming a first opening in at least the first inner side panel in the carrier formed from the blank and a second retention flap for forming a second opening in at least the second inner side panel in the carrier formed from the blank.

20. The blank of claim 19, wherein the at least one retention fold line comprises a first retention fold line and a second retention fold line, the first retention flap is foldably connected to the first inner side panel along the first retention fold line adjacent the first opening, and the second retention flap is foldably connected to the second inner side panel along the second retention fold line adjacent the second opening, the first retention fold line and the second retention fold line being for forming respective retention edges in the carrier formed from the blank.

21. The blank of claim 20, wherein each of the first retention fold line and the second retention fold line comprises a convex curve.

22. The blank of claim 20, wherein the first retention flap comprises a first inner portion foldably connected to a first outer portion along a first intermediate fold line, the second retention flap comprises a second inner portion foldably connected to a second outer portion along a second intermediate fold line.

23. The blank of claim 22, wherein the first retention flap is for extending at least partially between the first inner side panel and the first outer side panel when the carrier is formed from the blank, and the second retention flap is for extending at least partially between the second inner side panel and the second outer side panel when the carrier is formed from the blank.

24. The blank of claim 23, wherein the first retention flap is for being folded along the first intermediate fold line so that the first inner portion and the first outer portion extend upwardly from the first intermediate fold line when the carrier is formed from the blank, and the second retention flap is for being folded along the second intermediate fold line so that the second inner portion and the second outer portion extend upwardly from the second intermediate fold line when the carrier is formed from the blank.

25. The blank of claim 20, wherein the first inner side panel is foldably connected to the bottom panel along a first fold line, the second inner side panel is foldably connected to the bottom panel along a second fold line, the first retention flap is at least partially defined by a first cut line extending in the first inner side panel and the bottom panel, and the second retention flap is at least partially defined by a second cut line extending in the second inner side panel and the bottom panel.

26. The blank of claim 18, wherein the first inner side panel is for extending generally downwardly in a first oblique direction from the bottom panel to the first outer side panel when the carrier is formed from the blank, and the second inner side panel is for extending generally downwardly in a second oblique direction from the bottom panel to the second outer side panel when the carrier is formed from the blank.

27. The blank of claim 18, wherein the first inner side panel is foldably connected to the first outer side panel along a first fold line, the second inner side panel is foldably connected to the second outer side panel along a second fold line, the first fold line comprises at least one first curved portion aligned with the first retaining feature, and the second fold line comprises at least one second curved portion aligned with the second retaining feature.

28. The blank of claim 27, wherein the at least one first curved portion is curved toward the top panel so that the first inner side panel and the first outer side panel are partially curved inwardly at the first fold line when the carrier is formed from the blank, and the at least one second curved portion is curved toward the top panel so that the second inner side panel and the second outer side panel are partially curved inwardly at the second fold line when the carrier is formed from the blank.

29. A method of forming a package, comprising:

obtaining a blank comprising a bottom panel, a first inner side panel foldably connected to the bottom panel, a first outer side panel foldably connected to the first inner side panel, a second inner side panel foldably connected to the bottom panel, a second outer side panel foldably connected to the second inner side panel, a first top panel foldably connected to the first outer side panel, a second top panel foldably connected to the second outer side panel, and at least one container-receiving feature comprising a first retaining feature extending in at least the first inner side panel and an opposing second retaining feature extending in at least the second inner side panel, wherein at least one of the first retaining feature and the second retaining feature comprises at least one retention flap foldably connected to a respective one of the first inner side panel and the second inner side panel along at least one retention fold line;

engaging at least one container with the at least one container-receiving feature by folding the first inner side panel and the second inner side panel generally downwardly so that a top portion of the at least one container is at least partially retained in each of the first retaining feature and the second retaining feature and the at least one retention fold line engages an underside of the top portion of the at least one container; and forming a carrier having an interior by positioning the first top panel and the second top panel to overlap the bottom panel so that the bottom panel is at least partially disposed between the top portion of the at least one container and at least one of the first top panel and the second top panel.

30. The method of claim 29, wherein the at least one retention flap comprises a first retention flap and a second retention flap, and the engaging the at least one container with the at least one container-receiving feature further comprises folding the first retention flap relative to the first inner side panel to form a first opening in the first inner side panel, folding the second retention flap relative to the second inner side panel to form a second opening in the second inner side panel, and receiving at least a portion of the top portion of the at least one container in each of the first opening and the second opening.

31. The method of claim 30, wherein:

the at least one retention fold line comprises a first retention fold line and a second retention fold line, and the first retention flap is foldably connected to the first inner side panel along the first retention fold line and the second retention flap is foldably connected to the second inner side panel along the second retention fold line;

the folding the first retention flap comprises folding the first retention flap along the first retention fold line to form a first retention edge;

the folding the second retention flap comprises folding the second retention flap along the second fold line to form a second retention edge; and the engaging the at least one container with the at least one container-receiving feature further comprises engaging the first retention edge and the second retention edge of the at least one container-receiving feature with the underside of the top portion of the at least one container.

32. The method of claim 30, wherein:

the first retention flap comprises a first inner portion foldably connected to a first outer portion along a first intermediate fold line, and the second retention flap comprises a second inner portion foldably connected to a second outer portion along a second intermediate fold line;

the folding the first retention flap comprises folding the first outer portion relative to the first inner portion along the first intermediate fold line so that the first inner portion and the first outer portion extend generally upwardly from the first intermediate fold line; and the folding the second retention flap comprises folding the second outer portion relative to the second inner portion along the first intermediate fold line so that the second inner portion and the second outer portion extend generally upwardly from the second intermediate fold line.

33. The method of claim 29, wherein:

the first inner side panel is foldably connected to the first outer side panel along a first fold line, the second inner side panel is foldably connected to the second outer side panel along a second fold line, the first fold line comprises at least one first curved portion aligned with the first retaining feature, and the second fold line comprises at least one second curved portion aligned with the second retaining feature; and the forming the carrier comprises folding the first outer side panel generally upwardly along the first fold line so that the first inner side panel and the first outer side panel are partially curved inwardly toward the at least one container at the first fold line, and folding the second outer side panel generally upwardly along the second fold line so that the second inner side panel and the second outer side panel are partially curved inwardly toward the at least one container at the second fold line.

* * * * *